US011197591B2

(12) United States Patent
Dallaire

(10) Patent No.: US 11,197,591 B2
(45) Date of Patent: Dec. 14, 2021

(54) SHEET PRODUCT DISPENSER AND METHOD AND KIT TO CONVERT A SHEET PRODUCT DISPENSER

(71) Applicant: CASCADES CANADA ULC, Kingsey Falls (CA)

(72) Inventor: Antoine Dallaire, Montreal (CA)

(73) Assignee: CASCADES CANADA ULC, Kingsey Falls (CA)

( * ) Notice: Subject to any disclaimer, the term of this patent is extended or adjusted under 35 U.S.C. 154(b) by 0 days.

(21) Appl. No.: 16/667,220

(22) Filed: Oct. 29, 2019

(65) Prior Publication Data

US 2020/0196810 A1 Jun. 25, 2020

Related U.S. Application Data

(60) Provisional application No. 62/782,540, filed on Dec. 20, 2018.

(51) Int. Cl.
*A47K 10/42* (2006.01)
*A47K 10/32* (2006.01)

(52) U.S. Cl.
CPC .... *A47K 10/422* (2013.01); *A47K 2010/3233* (2013.01)

(58) Field of Classification Search
CPC ..... A47K 10/422; A47K 2010/3273; A47K 2010/3233
USPC ..... 221/59, 241
See application file for complete search history.

(56) References Cited

U.S. PATENT DOCUMENTS

| | | | | |
|---|---|---|---|---|
| 1,362,449 | A | 12/1920 | Teall | |
| 2,044,284 | A * | 6/1936 | Dargavel | A47F 1/08 118/425 |
| 2,108,825 | A | 2/1938 | Morris | |
| 2,117,396 | A | 5/1938 | Birr | |
| 2,343,814 | A | 3/1944 | Slye et al. | |
| 2,682,441 | A | 6/1954 | Krueger et al. | |
| 2,858,045 | A | 10/1958 | Loeb | |
| 3,066,825 | A | 12/1962 | Saxe | |
| 3,425,595 | A | 2/1969 | Shapira | |
| 4,329,001 | A | 5/1982 | Filipowicz et al. | |
| 4,667,846 | A * | 5/1987 | Marceau | A47K 10/32 221/34 |
| 4,762,113 | A * | 8/1988 | Hamasaki | B65D 81/3484 126/263.09 |
| 4,838,454 | A | 6/1989 | Salzmann et al. | |

(Continued)

FOREIGN PATENT DOCUMENTS

| | | |
|---|---|---|
| CA | 2610344 C | 1/2013 |
| DE | 19856010 A1 | 6/2000 |

(Continued)

*Primary Examiner* — Rakesh Kumar
(74) *Attorney, Agent, or Firm* — Marshall, Gerstein & Borun LLP

(57) ABSTRACT

There is provided a sheet product dispenser including a housing defining a product containing chamber and having an opening defined in a top portion thereof; and at least one product size adjustment plate insertable in the product containing chamber, detachably engageable with the housing, and obstructing at least partially the opening when engaged with the housing. There is also provided a kit of product size adjustment plates to be used in combination with a sheet product dispenser and a method to convert a sheet product dispenser.

19 Claims, 9 Drawing Sheets

(56) References Cited

U.S. PATENT DOCUMENTS 4,953,747 A 9/1990 Wenkman et al.
5,076,466 A 12/1991 Petterson et al.
5,249,547 A * 10/1993 Takada ..... B05C 3/18 118/415
5,931,339 A 8/1999 Dodge et al.
5,944,219 A 8/1999 Emoff et al.
6,331,696 B1 * 12/2001 Nakamura ..... A47K 10/422 219/386
6,830,157 B2 12/2004 Robertson et al.
7,063,209 B2 * 6/2006 Chen ..... B42D 5/006 206/181
D524,084 S 7/2006 Wieser et al.
7,121,426 B2 10/2006 Runnels
7,178,689 B2 2/2007 Wieser et al.
7,273,156 B2 9/2007 Gao et al.
RE40,408 E * 7/2008 McConnell ..... A47K 10/421 219/386
7,856,941 B2 * 12/2010 Nelson ..... B65H 35/0046 118/325
8,044,325 B1 * 10/2011 Cooper ..... A47K 10/32 219/386
8,991,646 B2 3/2015 Wieser
9,186,024 B2 * 11/2015 Lee ..... A47K 10/426
D784,039 S 4/2017 Chalko et al.
9,629,509 B1 * 4/2017 Keily ..... A47K 10/422
10,004,366 B2 * 6/2018 Chalko ..... A47K 10/422
2006/0086748 A1 4/2006 Burns et al.
2006/0273102 A1 * 12/2006 Wieser ..... A47K 10/422 221/59
2009/0084811 A1 * 4/2009 Nelson ..... B65H 35/0046 221/71
2015/0173573 A1 * 6/2015 Dunn ..... B65D 43/16 206/581
2020/0196810 A1 * 6/2020 Dallaire ..... A47K 10/422

FOREIGN PATENT DOCUMENTS

ES 1011813 U 6/1990
GB 738550 A 10/1955
KR 20020042284 A 6/2002

* cited by examiner

SHEET PRODUCT DISPENSER AND METHOD AND KIT TO CONVERT A SHEET PRODUCT DISPENSER

CROSS-REFERENCE TO RELATED APPLICATIONS

This application claims the benefit of the filing date of U.S. provisional patent application 62/782,540 filed on Dec. 20, 2018, the entirety of which is hereby incorporated by reference.

TECHNICAL FIELD OF THE INVENTION

The technical field relates to a dispenser for sheet products, such as folded absorbent sheet products, configurable to contain plural sizes of sheet products. It also relates to a method and a kit for converting a sheet product dispenser in accordance with the size of sheet products to be contained therein.

BACKGROUND

Sheet product dispensers, such as napkins or hand towels dispensers are known in the art. They are typically devices for dispensing single sheets from a stack of sheet products, which can be folded sheets (e.g. folded napkins or folded paper towels). In some implementations, these devices are spring-biased, i.e. the stack is urged towards a dispensing opening by one or more biasing devices, where the sheets are pulled from the opening by a user.

It is known in the art that stacks of sheets can be provided in various formats, each format being characterized by a length and a width of the stack. Typically, each sheet product dispenser is conceived to contain a stack of sheet products having a predetermined format. However, it may happen that one might one to refill a particular dispenser with a stack of sheet products characterized by a different format than the predetermined one. If the new stack of sheet products is smaller than the predetermined format, the new stack may fit inside the dispenser but the equilibrium of the stack and consequently, the efficiency of the dispenser may be challenged.

BRIEF SUMMARY OF THE INVENTION

It is therefore an aim of the present invention to address the above-mentioned issues.

According to a general aspect, there is provided a sheet product dispenser comprising: a housing defining a product containing chamber and comprising an opening defined in a top portion thereof; and at least one product size adjustment plate insertable in the product containing chamber, detachably engageable with the housing, and obstructing at least partially the opening when engaged with the housing.

According to another general aspect, there is provided a sheet product dispenser comprising: a housing defining a product containing chamber; a product holding platform inserted in the product containing chamber and translatably mounted to the housing, the product holding platform being configured to support a stack of sheet products thereon; and at least one product size adjustment plate insertable in the product containing chamber and detachably engageable with the housing in vicinity of the product holding platform to limit a surface area of the stack of sheet products insertable in the product containing chamber and supported by the product holding platform.

In an embodiment, the housing comprises a bottom wall, a peripheral wall extending upwardly from the bottom wall and defining together the product containing chamber.

According to still another general aspect, there is provided a method to convert a sheet product dispenser including a housing defining a product containing chamber and a product holding platform inserted in the product containing chamber and translatably mounted to the housing, the product holding platform being configured to support a stack of sheet products thereon and the housing having an opening defined in a top portion thereof. The method comprises: determining a surface area of the stack of sheet products to be contained in the product containing chamber; and if the surface area of the stack of sheet products is smaller than the opening defined in the top portion of the housing, inserting at least one product size adjustment plate in the product containing chamber and engaging the at least one product size adjustment plate with the housing in vicinity of the product holding platform to limit the surface area of the stack of sheet products insertable in the product containing chamber and supported by the product holding platform.

According to still a further general aspect, there is provided a sheet product dispenser comprising: a housing defining a product containing chamber and comprising an opening defined in a top portion thereof and providing access to the product containing chamber; and at least one product size adjustment plate insertable in the product containing chamber, detachably engageable with the housing, and obstructing at least partially the opening when engaged with the housing.

The sheet product dispenser can further comprise a product holding platform inserted in the product containing chamber and translatably mounted to the housing, the product holding platform being configured to support a stack of sheet products thereon, wherein the at least one product size adjustment plate is detachably engageable with the housing in vicinity of the product holding platform.

In an embodiment, the housing comprises a bottom wall, a peripheral wall extending upwardly from the bottom wall and defining together the product containing chamber. The housing can further comprise an inner skirt extending inwardly from an upper edge of the peripheral wall with an inner edge of the inner skirt delimitating the opening. The at least one product size adjustment plate can comprise an upper surface filing substantially entirely a spacing defined between an edge delimitating the opening of the housing and an edge of the product holding platform when configured in a raised configuration, when the at least one product size adjustment plate is engaged with the housing. The at least one product size adjustment plate can extend substantially vertically in the product containment chamber and is insertable in the product containing chamber through the opening. The at least one product size adjustment plate can comprise an upper surface which is substantially aligned with an edge delimitating the opening of the housing when engaged with the housing. The upper surface of the at least one product size adjustment plate can comprise a resilient catch detachably engageable with the housing when the at least one product size adjustment plate is engaged therewith.

In an embodiment, the at least one product size adjustment plate and the housing comprises complementary male-female members to detachably engage the at least one product size adjustment plate with the housing. The at least one product size adjustment plate can comprise male members at a lower edge thereof and the housing can comprise complementary female members adjacent to a bottom wall of the housing and located into the product containing chamber.

In an embodiment, the housing comprises guiding tracks extending in the product containing chamber, the product holding platform comprises protruding tabs having an end slidably engaged with the guiding tracks, and the at least one product size adjustment plate comprises at least one elongated slot being substantially aligned with a respective one of the guiding tracks with a respective one of the protruding tabs extending into the at least one elongated slot. The at least one elongated slot defined in the at least one product size adjustment plate can be open at a lower edge of the at least one product size adjustment plate.

A surface area of the opening can be greater than a surface area of the product holding platform.

The at least one product size adjustment plate can comprise two product size adjustment plates detachably engageable with the housing at two opposed edges of the product holding platform.

According to still another general aspect, there is provided a sheet product dispenser comprising: a housing defining a product containing chamber; a product holding platform inserted in the product containing chamber and translatably mounted to the housing, the product holding platform being configured to support a stack of sheet products thereon; and at least one product size adjustment plate insertable in the product containing chamber and detachably engageable with the housing in vicinity of the product holding platform to limit a surface area of the stack of sheet products insertable in the product containing chamber and supported by the product holding platform.

In an embodiment, the housing comprises a bottom wall, a peripheral wall extending upwardly from the bottom wall and defining together the product containing chamber.

The housing further can comprise an inner skirt extending inwardly from an upper edge of the peripheral wall with an inner edge of the inner skirt delimitating an opening providing access to the product containing chamber. The at least one product size adjustment plate can comprise an upper surface filing substantially entirely a spacing defined between an edge delimitating the opening of the housing and an edge of the product holding platform when configured in a raised configuration, when the at least one product size adjustment plate is engaged with the housing. The at least one product size adjustment plate can extend substantially vertically in the product containment chamber.

In an embodiment, the at least one product size adjustment plate comprises an upper surface which is substantially aligned with an edge delimitating an opening of the housing when engaged with the housing.

The upper surface of the at least one product size adjustment plate can comprise a resilient catch detachably engageable with the housing when the at least one product size adjustment plate is engaged therewith.

In an embodiment, the at least one product size adjustment plate and the housing comprises complementary male-female members to detachably engage the at least one product size adjustment plate with the housing. The at least one product size adjustment plate can comprise male members at a lower edge thereof and the housing can comprise complementary female members adjacent to a bottom wall of the housing and located into the product containing chamber.

In an embodiment, the housing comprises guiding tracks extending in the product containing chamber, the product holding platform comprises protruding tabs having an end slidably engaged with the guiding tracks, and the at least one product size adjustment plate comprises at least one elongated slot being substantially aligned with a respective one of the guiding tracks with a respective one of the protruding tabs extending into the at least one elongated slot. The at least one elongated slot defined in the at least one product size adjustment plate can be open at a lower edge of the at least one product size adjustment plate.

In an embodiment, a surface area of the opening is greater than a surface area of the product holding platform.

In an embodiment, the at least one product size adjustment plate comprises two product size adjustment plates detachably engageable with the housing at two opposed edges of the product holding platform.

According to another general aspect, there is provided a kit of product size adjustment plates in combination with a sheet product dispenser. The sheet product dispenser comprises: a housing defining a product containing chamber; and a product holding platform inserted in the product containing chamber and translatably mounted to the housing, the product holding platform being configured to support a stack of sheet products thereon. The kit of product size adjustment plates comprises at least two product size adjustment plates insertable in the product containing chamber and detachably engageable with the housing in vicinity of the product holding platform to limit a surface area of the stack of sheet products insertable in the product containing chamber and supported by the product holding platform.

In an embodiment, the at least two product size adjustment plates comprise an upper surface and two of the at least two product size adjustment plates have a different surface area.

According to another general aspect, there is provided a method to convert a sheet product dispenser including a housing defining a product containing chamber and a product holding platform inserted in the product containing chamber and translatably mounted to the housing. The product holding platform is configured to support a stack of sheet products thereon and the housing having an opening defined in a top portion thereof. The method comprises: evaluating a surface area of the stack of sheet products to be contained in the product containing chamber; and if the surface area of the stack of sheet products is smaller than a surface area of the opening defined in the top portion of the housing, inserting at least one product size adjustment plate in the product containing chamber and engaging the at least one product size adjustment plate with the housing in vicinity of the product holding platform.

In an embodiment, engaging the at least one product size adjustment plate with the housing comprises engaging together complementary male-female members provided on the at least one product size adjustment plate and the housing together.

In an embodiment, engaging the at least one product size adjustment plate with the housing comprises engaging a resilient catch provided on an upper surface of the at least one product size adjustment plate with the housing.

BRIEF DESCRIPTION OF THE DRAWINGS

FIG. 9 includes FIGS. 9*a*, 9*b*, and 9*c*.

It will be noted that throughout the appended drawings, like features are identified by like reference numerals.

DETAILED DESCRIPTION

Figure 1:
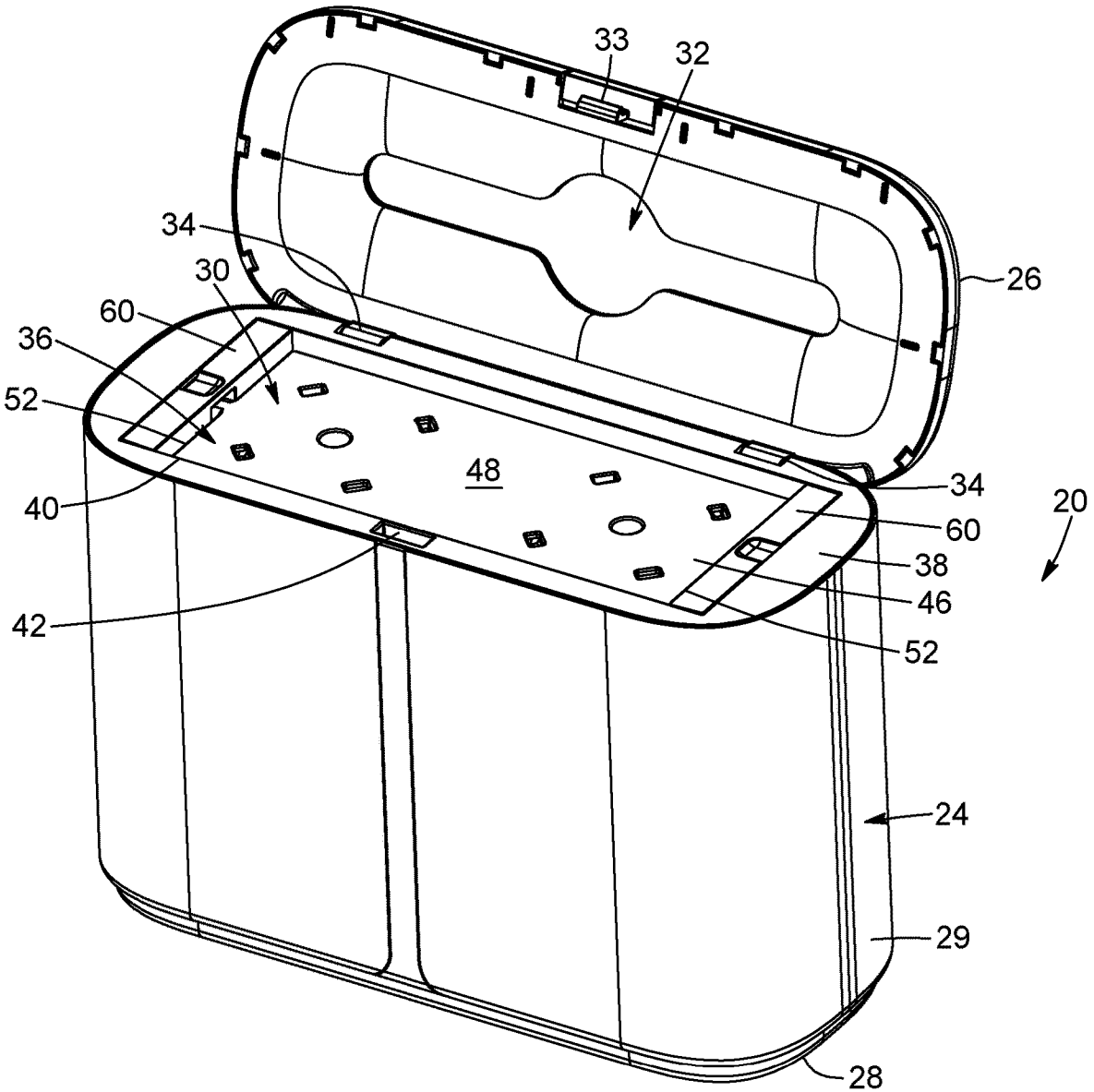
FIG. 1 is a perspective view of a sheet product dispenser, in accordance with an embodiment, including two product size adjustment plates engaged within a housing of the sheet product dispenser.

Moreover, although the embodiments of the sheet product dispenser and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation therein between, as well as other suitable geometrical configurations, may be used for the sheet product dispenser, as will be briefly explained herein and as can be easily inferred herefrom by a person skilled in the art.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional and are given for exemplification purposes only.

Moreover, it will be appreciated that positional descriptions such as "above", "below", "forward", "rearward", "left", "right", and the like should, unless otherwise indicated, be taken in the context of the figures and correspond to the position and orientation of the sheet product dispenser and corresponding parts sit on a supporting surface, such as a table top or a counter top. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the above description, an embodiment is an example or implementation of the inventions. The various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment. Reference in the specification to "some embodiments", "an embodiment", "one embodiment", or "other embodiments", means that a particular feature, structure, or characteristic described in connection with the embodiments is included in at least some embodiments, but not necessarily in all embodiments, of the inventions.

It is to be understood that the phraseology and terminology employed herein are not to be construed as limiting and are for descriptive purposes only. It is to be understood that the details set forth herein do not construe a limitation to an application of the invention. Furthermore, it is to be understood that the invention can be carried out or practiced in various ways and that the invention can be implemented in embodiments other than the ones outlined in the description above.

The principles and uses of the teachings of the present invention may be better understood with reference to the accompanying description, figures and examples.

It is to be understood that the terms "including", "comprising", and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can", or "could" be included, that particular component, feature, structure, or characteristic is not required to be included.

The descriptions, examples, methods and materials presented in the claims and the specification are not to be construed as limiting but rather as illustrative only.

Figure 2:
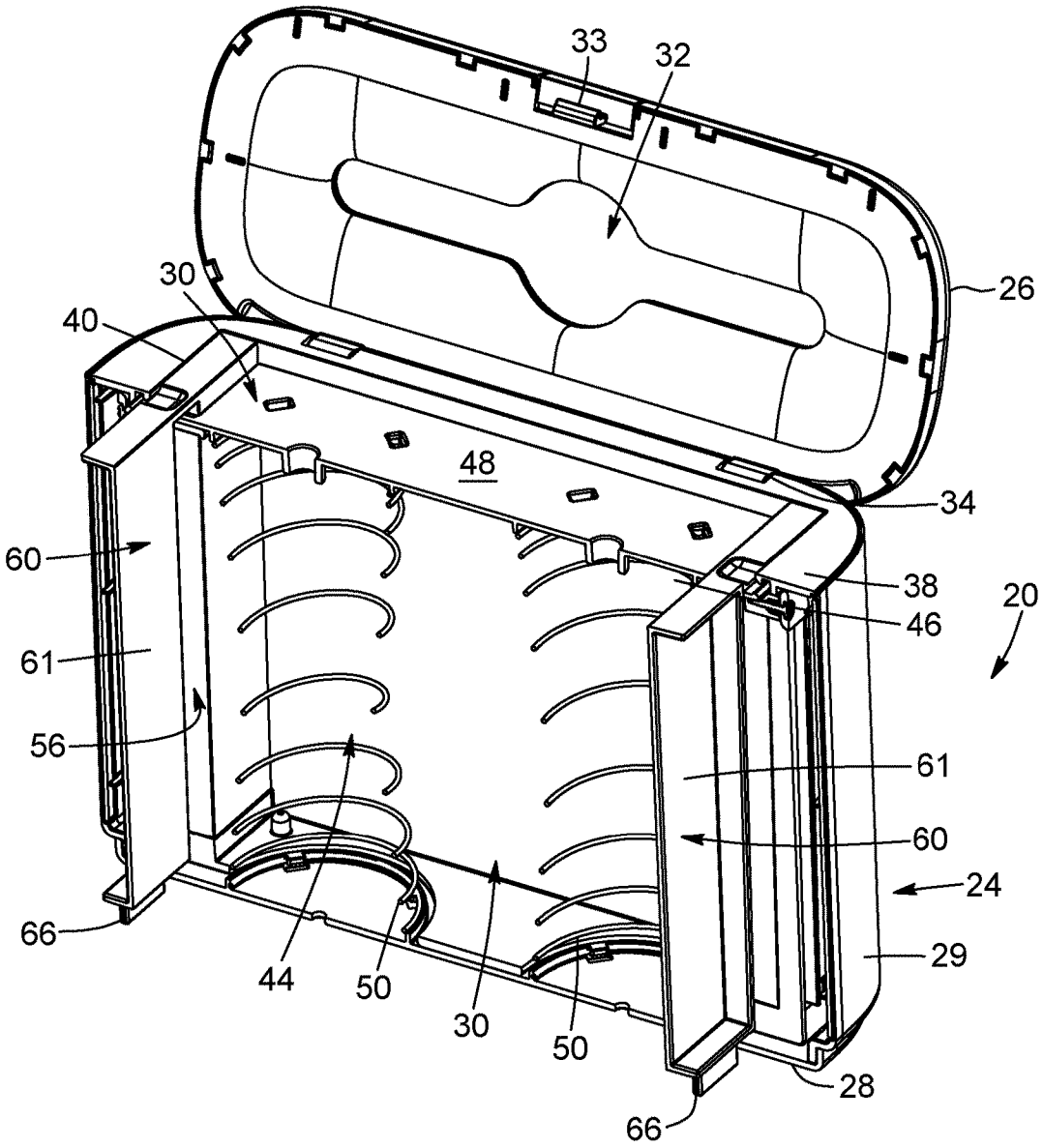
FIG. 2 is a sectional view of the sheet product dispenser shown in FIG. 1.
Figure 10:
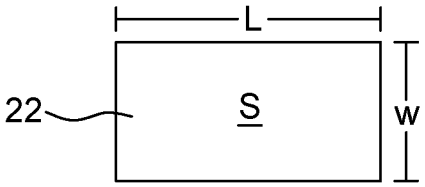
FIG. 10 is a top plan view of a stack of sheet product insertable in the sheet product dispenser.

Referring now to the figures and, more particularly, referring to FIGS. 1 and 2, there is shown a sheet product dispenser 20 for dispensing sheet products 22 provided in a stack (FIG. 10). The sheet products 20 may be folded or unfolded. The sheet products can be stacked on top of one another, and can be at least partially overlapped or interfolded.

As shown in FIG. 10, the sheet products 22 form a stack having a stack surface area S with a length L and a width W.

The term "sheet products" as used herein includes absorbent sheet products, such as paper products (hand towels, facial towels, or napkins) but also absorbent nonwoven products including wipes, pure or hybrid nonwoven/pulp products, airlaid products, etc.

The sheet product dispenser 20 includes a housing 24 and a cover 26 pivotally mounted to the housing 24 in a top portion thereof.

The housing 24 includes a bottom wall 28, a peripheral wall 29 extending upwardly from the bottom wall 28 and defining together a product containing chamber 30.

In non-limitative embodiments, the housing 24 and the cover 26 can be formed from plastic, metal, or composite material.

The cover 26 has a dispending opening 32 defined therein. It is appreciated that the shape and the position of the dispending opening 32 can vary from the embodiment shown in the figures. The cover 26 is pivotally mounted to the top portion of the housing 24 through hinges 34. However, in alternative embodiments (not shown), the sheet product dispenser can be free of cover, or the cover can be engageable with the housing 24 without being compulsorily pivotally mounted thereto.

Opposed to the side including the hinges 34 (i.e. the side that is pivotally mounted to the housing 24), the cover 26 includes a catch 33 engageable with the housing 24, as will be described in more details below.

In the embodiment, the cover 26 is selectively configurable in an open configuration, as shown in the FIGS. 1 to 4, and in a closed configuration. In the open configuration, access is provided to the product containing chamber 30 to modify the interior configuration of the dispenser 20, as will be described in more details below, or to refill the dispenser 20.

The housing 24 of the dispenser 20 comprises an opening 36 defined in the top portion. Sheet products can be inserted in the product containing chamber 30 through the opening 36 when the cover 26 is configured in the open configuration. In its closed configuration, the cover 26 limits access to the opening 36 and the product containing chamber 30. It is appreciated that the shape and configuration of the opening 36 can vary from the embodiment shown and can be shaped in accordance with the sheet products to be contained in and dispensed from the dispenser 20.

In the embodiment shown, the housing 24 also includes an inner skirt 38 extending inwardly from an upper edge of the peripheral wall 29. An inner edge 40 of the inner skirt 38 delimits the opening 36. In the non-limitative embodiment shown, the inner skirt 38 has a notch 42 defined therein, substantially aligned with the catch 33 of the cover 26 in the closed configuration of the cover 26. Thus, the catch 33 is insertable in the notch 42, and engageable with the inner skirt 38 of the housing 24 to maintain the cover 26 in the closed configuration.

It is appreciated that, in an alternative embodiment (not shown), the housing 24 can be free of inner skirt and the opening 36 can be delimited by the upper edge of the peripheral wall 29.

The dispenser 20 also includes a dispensing mechanism 44, mainly contained in the product containing chamber 30. The dispensing mechanism 44 includes a product holding platform 46 inserted in the product containing chamber 30 and translatably mounted to the housing 24. The product holding platform 46 includes an upper surface 48 configured to contact and support the stack of sheet products thereon.

The product containing chamber 30 also includes a biasing device 50 to raise the product holding platform 46 as the sheet product is dispensed. The biasing device 50, which is embodied by two spaced-apart springs in the embodiment shown, is located under the platform 46, having a first end abutting against a lower surface of the platform 46, and a second end abutting against the bottom wall 28 of the housing 24. The biasing device 50 applies pressure against the platform 46 and the stack of sheet products supported thereon. More particularly, the biasing device 50 urges the platform 46 from a position closer to the bottom wall 28 of the housing 24 to a position closer to the cover 26, as the sheet products are dispensed.

In the embodiment shown, the platform 46 is substantially rectangular in shape with two opposed ends 52, including outwardly protruding tabs 54 (FIG. 4), i.e. male members. It is appreciated that the shape of the platform 46 as well as the position and shape of the tabs 54 can vary from the embodiment shown.

Figure 4:
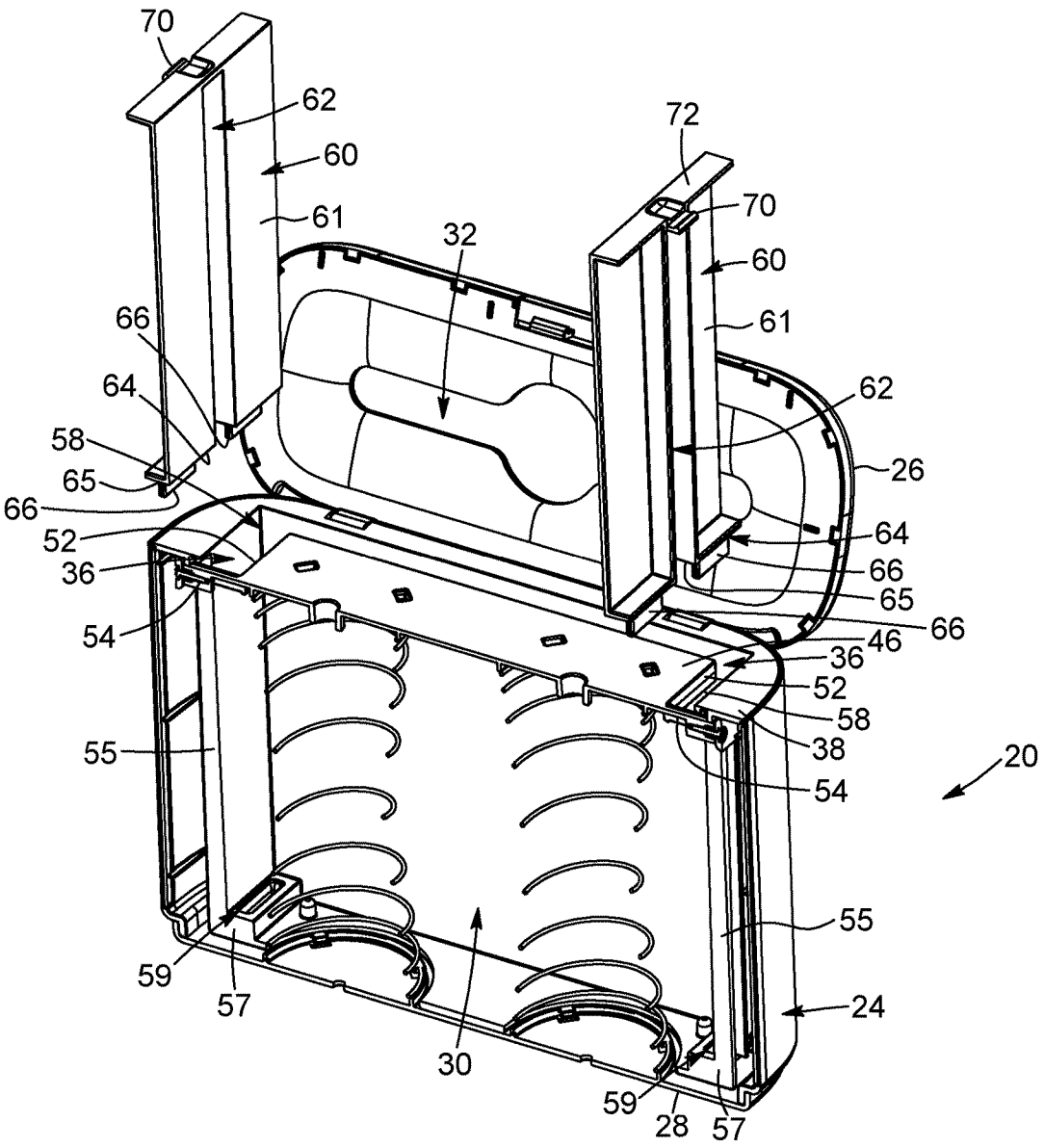
FIG. 4 is a sectional view of the sheet product dispenser shown in FIG. 3.
Figure 5:
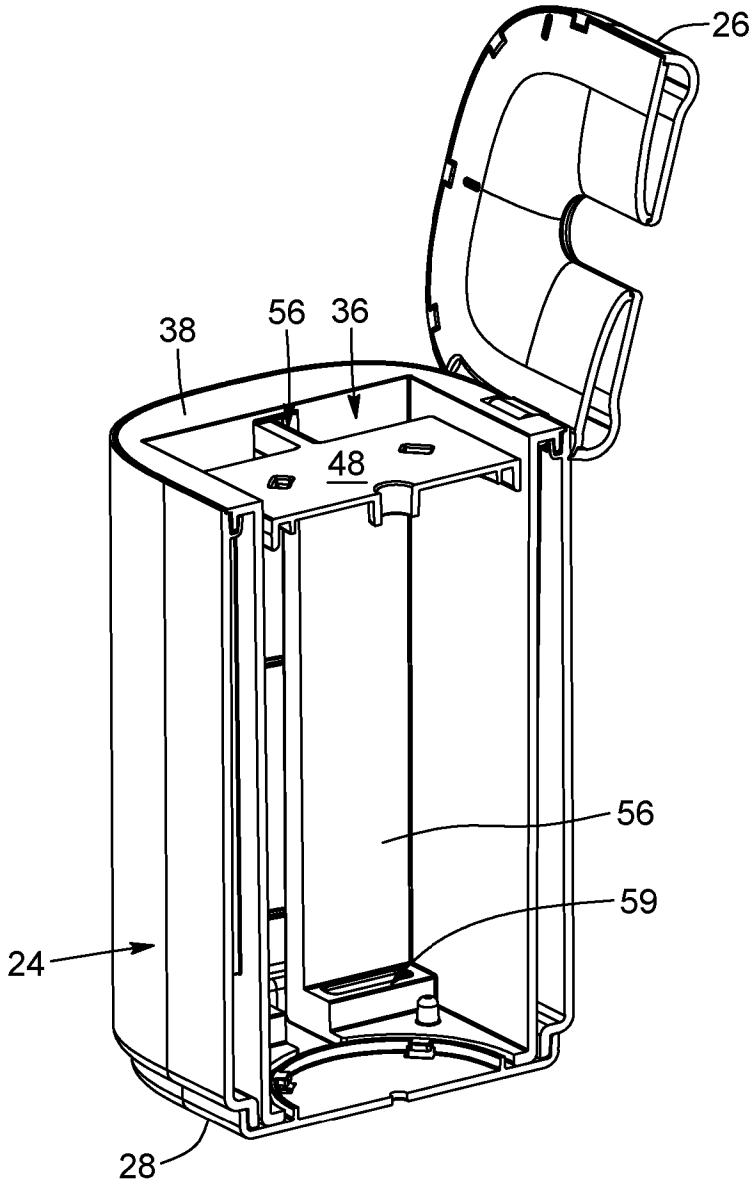
FIG. 5 is another sectional view of the sheet product dispenser shown in FIG. 3.

In the embodiment shown in FIGS. 4 and 5, inside the product containing chamber 30, the housing 24 is provided with two inner walls 55 extending substantially vertically between the inner edge 40 of the inner skirt 38 and the bottom wall 28 of the housing 24. In the embodiment shown, the inner walls 55 are provided at two opposed ends of the housing 24, inside the product containing chamber 30. The inner walls 55 are provided with an inwardly protruding foot 57 at a lower end thereof. Two apertures 59 (female members) are defined in each one of the inwardly protruding feet 57 (only one is shown), the purpose of which will be described in more details below.

Each one of the inner walls 55 of the housing 24 includes a guiding track 56 (FIG. 4), i.e. female members, extending at least partially along a height thereof. The two outwardly protruding tabs 54 of the platform 46 are engaged with a respective one of the guiding tracks 56 and slidable therealong. It is appreciated that the number, position and configuration of the outwardly protruding tabs 54 and the complementary guiding tracks 56 can vary from the embodiment shown. Furthermore, the platform 46 can be provided with female members and the housing 24 can be provided with complementary male members engageable into the female members of the platform 46 and allowing a vertical translation of the platform 46 inside the dispenser 20.

Furthermore, the complementary male/female members provide to guide the vertical translation of the platform 46 inside the product containing chamber 30 can be provided on another structure than the inner walls 55. In an alternative embodiment (not shown), the housing 24 can be free of inner walls 55 with guiding tracks 56 or protruding tabs 54 being provided on the peripheral wall 29 or protruding from an inner surface of the peripheral wall 29.

Figure 3:
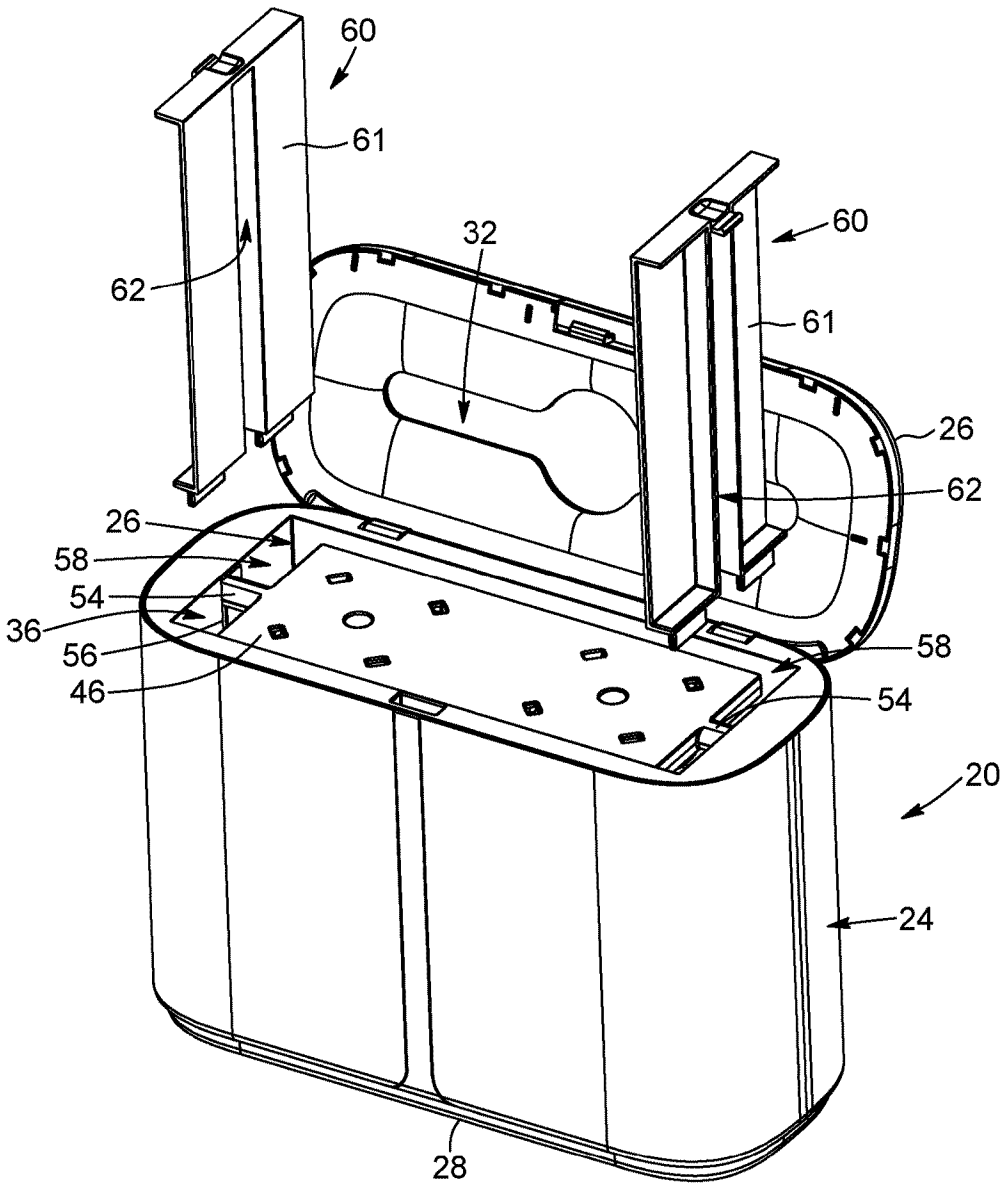
FIG. 3 is a perspective view of the sheet product dispenser shown in FIG. 1, wherein the two product size adjustment plates are disengaged and removed from the sheet product dispenser.

As shown in FIGS. 3 and 4, in an embodiment, the surface area of the opening 36 is greater than the surface area of the platform 46. More particularly, the platform 46 is spaced-apart from the inner skirt 38 of the housing 24 at the two opposed ends 52, including the guiding tracks 56 in a manner such that spacings 58 are defined between inner edges 40 of the inner skirt 38 and end edges of the platform 46. These spacings 58 allow insertion, in the product containing chamber 30, of stack of sheet products having a greater surface area S than the surface area of the platform 46. More particularly, in the embodiment shown, the stack of sheet products can be longer than a length of the platform 46, and up to a length of the opening 36.

It is appreciated that, in an alternative embodiment, the platform 46 is spaced-apart from the inner skirt 38 of the housing 24 along the longitudinal edges of the platform 46, i.e. normal to the two opposed ends 52 including the guiding tracks 56. Thus, spacings 58 can be provided along the widthwise and/or the lengthwise dimension.

In an embodiment wherein the housing 24 would be free of inner skirt, the spacings can be defined between the end edges of the platform 46 and the upper edge of the peripheral wall 29.

It is appreciated that one might fill the product containing chamber 30 of the dispenser 20 with a stack of sheet products having a surface area smaller than the surface area of the opening 36. To stabilize the stack of sheet products having an inferior surface area in comparison to the surface area of the opening 36 inside the product containing chamber 30 of the dispenser 20, at least one product size adjustment plate 60 can be inserted in the product containing chamber 30 and detachably engageable with the housing 24 in vicinity of the product holding platform 46 to limit a surface area to contain the stack of sheet product. In the embodiment shown in FIGS. 1 and 2, two product size adjustment plates 60 are inserted in the product containing chamber 30 and detachably engaged with the bottom wall 28 of the housing 24, a respective one of the product size adjustment plates 60 filling each one of the spacings 58.

In the embodiment shown, the product size adjustment plates 60 entirely fill the spacings 58 defined between inner edges 40 of the inner skirt 38 and end edges of the platform 46 while still allowing vertical translation of the platform 46 inside the product containing chamber 30. In an alternative embodiment (not shown), the product size adjustment plate (s) can partially fill the spacings 58.

Even though two product size adjustment plates 60 are shown in the figures, it is appreciated that the dispenser 20 can include only one product size adjustment plate, or more than two. If the dispenser 20 includes two or more product size adjustment plates 60, one of them can extend along an axis extending perpendicular to the other one, for instance along a width and a length of the translatable platform 46.

Figure 6:
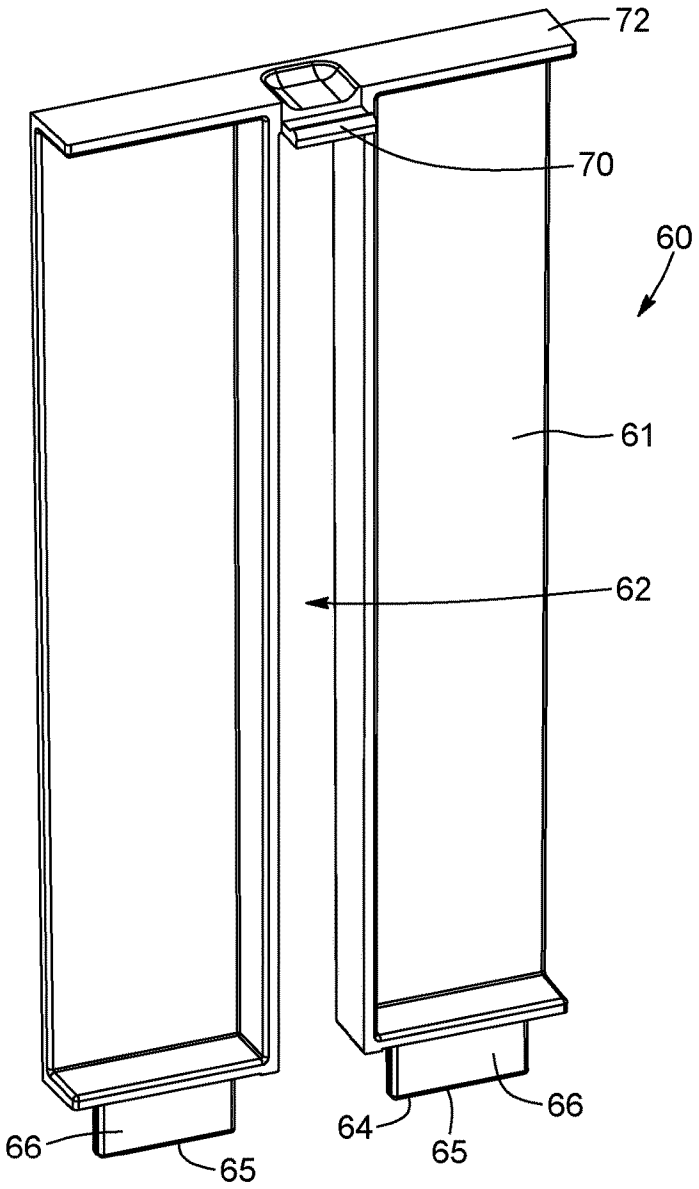
FIG. 6 is a perspective view of one of the product size adjustment plates in accordance with an embodiment.

The two product size adjustment plates 60 being substantially identical, only one will be described in the following paragraphs in reference to FIGS. 4 and 6.

In the embodiment shown, the product size adjustment plate 60 has a vertically-extending wall 61 extending in the product containing chamber 30 and along one of the end edges of the platform 46. The vertically-extending wall 61 of the product size adjustment plate 60 is provided with an elongated slot 62 extending therethrough from a lower end 64 and opened at the lower edge 65. The lower edge 65 is configured to be located adjacent to the bottom wall 28 of the housing 24 when the product size adjustment plate 60 is engaged therewith, as will be described in more details below. A respective one of the outwardly protruding tabs 54 extends through the elongated slot 62 with its free end engaged into a respective one of the guiding tracks 56, located on the opposite side of the product size adjustment plate 60 with respect to the platform 46, when the product size adjustment plate 60 is inserted into the product containing chamber 30, and engaged with the housing 24.

At the lower end 64, the product size adjustment plate 60 is provided with two tabs 66, spaced-apart from one another by the elongated slot 62. The tabs 66 are removably engageable into the apertures 59 defined in the inwardly protruding foot 57 of the inner wall 55 to engage the product size adjustment plate 60 with the housing 24.

It is appreciated that the configuration of the engagement between product size adjustment plate 60 and the housing 24 can vary from the embodiment shown. For instance and without being limitative, the product size adjustment plate 60 can be provided with the female member(s), while the housing 24 can be provided with the complementary male member(s).

In an upper portion thereof, the product size adjustment plate 60 can include a resilient catch 70 configured to be inserted under and to engage the inner edge 40 of the inner skirt 38 when the product size adjustment plate 60 is engaged with the housing 24. The engagement between the resilient catch 70 and the housing 24 maintains the upper portion of the product size adjustment plate 60 abutted against the inner edge 40 of the inner skirt 38.

As shown in FIGS. 1 and 4, in the embodiment shown, when inserted in the product containing chamber 30 and engaged with the housing 24, an upper surface 72 of product size adjustment plate 60 is substantially aligned with an upper surface of inner skirt 38 (or upper edge of the peripheral wall 29).

In an embodiment, the dispenser 20 can be provided with a plurality of product size adjustment plates 60 characterized by different thicknesses (t). The product size adjustment plates 60 can be selected in accordance with their thickness (t) and the surface area of the stack of sheet products to be inserted in the dispenser 20.

Figure 7A:
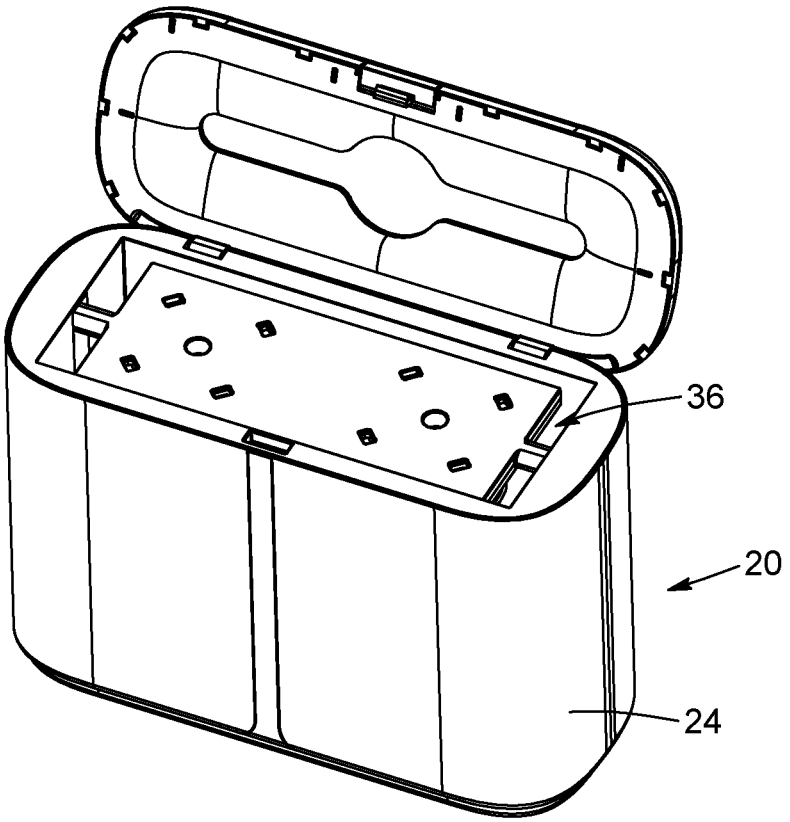
FIG. 7 includes FIGS. 7*a* and 7*b* which are respectively perspective and top plan view of the sheet product dispenser shown in FIG. 3, i.e. without the product size adjustment plates.
Figure 7B:
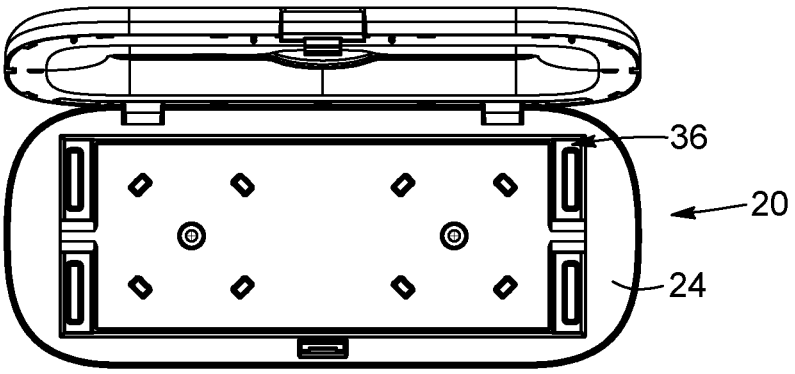
Figure 8A:
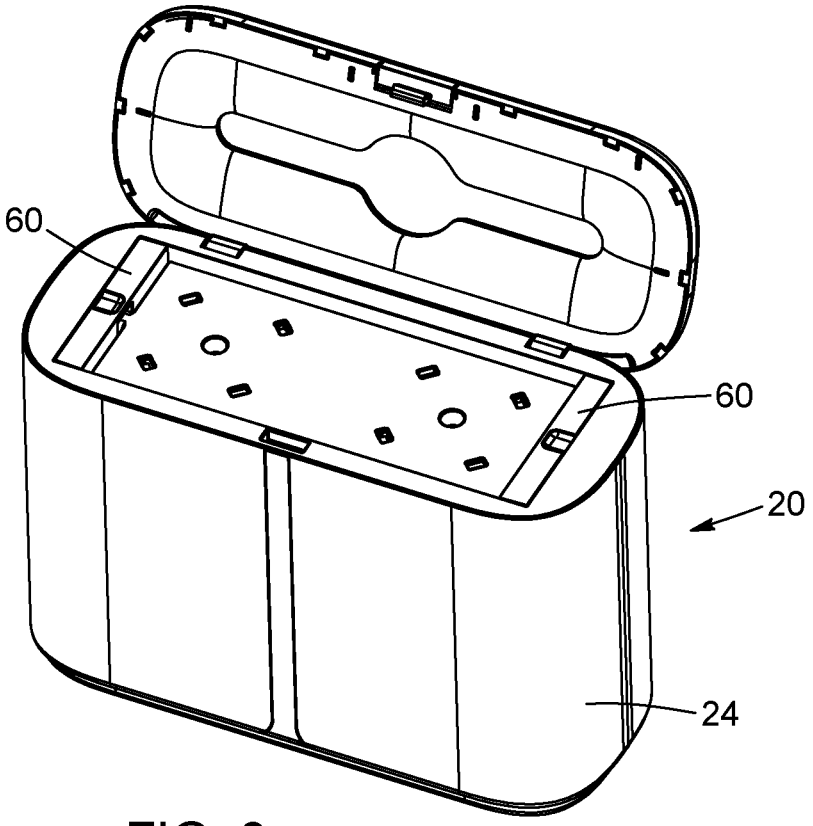
FIG. 8 includes FIGS. 8*a* and 8*b* which are respectively perspective and top plan view of the sheet product dispenser shown in FIG. 1, i.e. with the product size adjustment plates engaged within the housing of the sheet product dispenser.
Figure 8B:
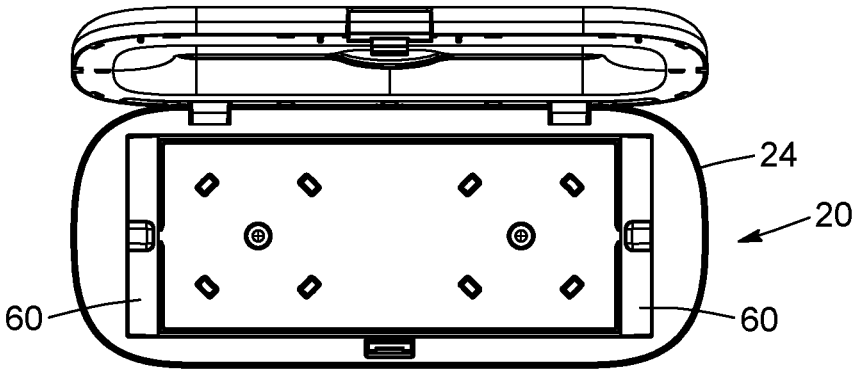

Turning now to FIGS. 7 and 8, there is shown that, when the product size adjustment plates 60 are removed from the dispenser (FIG. 7), the opening 36 is unobstructed and a stack of sheet products having a greater surface area, for instance and without being limitative, 9.0 inches×3.25 inches (L×W), can be inserted and contained therein. When a stack of sheet products characterized by a surface area smaller than the opening 36 is inserted inside the dispenser 20, for instance and without being limitative, 8.1 inches× 3.25 inches (L×W), to stabilize the product stack while being dispensed, one may insert the product size adjustment plates 60 in the product containing chamber 30 before inserting the stack, and engage the product size adjustment plates 60 with the housing 24, as described hereinabove. Thus, a single sheet product dispenser 20 can be used to contain and dispense stacks of sheet products characterized by different surface areas.

Figure 9A:
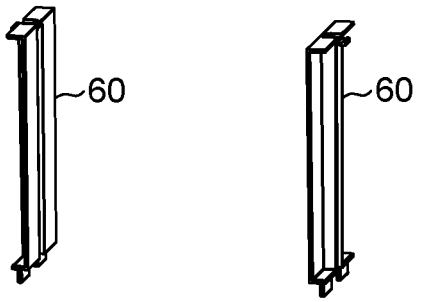
FIG. 9*a* is a perspective view of two product size adjustment plates before being inserted in the housing of the sheet product dispenser.
Figure 9B:
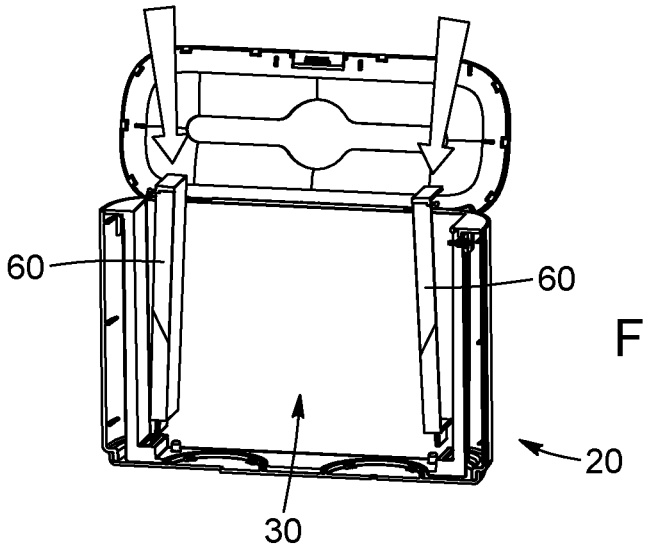
FIG. 9*b* is a sectional view of the sheet product dispenser with the product size adjustment plates being inserted therein.
Figure 9C:
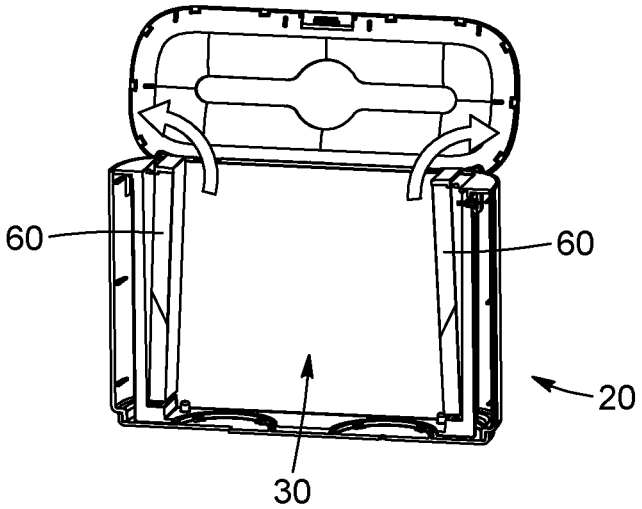
FIG. 9*c* is a sectional view of the sheet product dispenser with the product size adjustment plates inserted therein.

Referring now to FIG. 9, there is shown that the product size adjustment plates 60 are aligned with a respective one of the spacings 58 with their vertically-extending wall 61 facing inwardly and slid into the chamber 30 through the spacings 58 and engaged with the housing 24. In the embodiment shown, to engage the product size adjustment plates 60 with the housing 24, the tabs 66 are inserted into the apertures 59 defined in the inwardly protruding feet 57 of the inner walls 55, and then the product size adjustment plates 60 are pivoted outwardly to complete the engagement between the catch 70 and the inner skirt 38.

To disengage and remove the product size adjustment plates 60 from the housing 24, the catch 70 is pressed downwardly to be disengaged from the inner skirt 38, and then the product size adjustment plates 60 are pivoted inwardly and slid outwardly from the product containing chamber 30.

Thus, the surface area of the stack of sheet products to be contained in the product containing chamber 30 should be determined; and if the surface area of the stack of sheet products is smaller than the opening defined in the top portion of the housing 24, at least one product size adjustment plate 60 could be inserted in the product containing chamber 30 and engaged with the housing 24 in vicinity of the product holding platform 46 to limit the surface area of the stack of sheet products insertable in the product containing chamber 30 and supported by the product holding platform 46.

There is also provided a kit of product size adjustment plates, which can be used in combination with a sheet product dispenser, as described above. In an embodiment, the kit of product size adjustment plates includes at least two product size adjustment plates insertable in the product containing chamber and detachably engageable with the housing in vicinity of the product holding platform to limit a surface area of the stack of sheet products insertable in the product containing chamber and supported by the product holding platform. In an embodiment, the at least two product size adjustment plates have an upper surface and two of the at least two product size adjustment plates have a different surface area.

It will be appreciated that the methods described herein may be performed in the described order, or in any suitable order.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

What is claimed is:

1. A sheet product dispenser comprising:

a housing defining a product containing chamber and comprising a peripheral wall and a skirt extending inwardly from an upper edge of the peripheral wall, the skirt having comprising an opening defined therein and providing access to the product containing chamber;

at least one product size adjustment plate insertable in the product containing chamber, detachably engageable with the housing, and obstructing at least partially the opening when engaged with the housing;

a product holding platform inserted in the product containing chamber and translatably mounted to the housing, the product holding platform being configured to support a stack of sheet products thereon, the at least one product size adjustment plate being detachably engageable with the housing in vicinity of the product holding platform, the housing including guiding tracks extending in the product containing chamber, the product holding platform having protruding tabs having an end slidably engaged with the guiding tracks, and the at least one product size adjustment plate including at least one elongated slot open at a lower edge and being substantially aligned with a respective one of the guiding tracks with a respective one of the protruding tabs extending into the at least one elongated slot.

2. The sheet product dispenser as claimed in claim 1, wherein the at least one product size adjustment plate comprises two product size adjustment plates detachably engageable with the housing at two opposed edges of the product holding platform.

3. The sheet product dispenser as claimed in claim 1, wherein the housing comprises a bottom wall, the peripheral wall extending upwardly from the bottom wall and defining together the product containing chamber, and wherein the opening is delimited by an inner edge of the skirt.

4. The sheet product dispenser as claimed in claim 1, wherein the at least one product size adjustment plate comprises an upper surface filing substantially entirely a spacing defined between an edge delimitating the opening of the skirt and an edge of the product holding platform when configured in a raised configuration, when the at least one product size adjustment plate is engaged with the housing.

5. The sheet product dispenser as claimed in claim 1, wherein the at least one product size adjustment plate comprises an upper surface which is substantially aligned with an edge delimitating the opening of the skirt when engaged with the housing.

6. The sheet product dispenser as claimed in claim 1, wherein the at least one product size adjustment plate and the housing comprises complementary male-female members to detachably engage the at least one product size adjustment plate with the housing.

7. The sheet product dispenser as claimed in claim 6, wherein the at least one product size adjustment plate comprises male members at a lower edge thereof and the housing comprises complementary female members adjacent to a bottom wall of the housing and located into the product containing chamber.

8. The sheet product dispenser as claimed in claim 1, wherein a surface area of the opening is greater than a surface area of the product holding platform.

9. A sheet product dispenser comprising:

a housing defining a product containing chamber;

a product holding platform inserted in the product containing chamber and translatably mounted to the housing, the product holding platform being configured to support a stack of sheet products thereon; and at least one product size adjustment plate insertable in the product containing chamber and detachably engageable with the housing in vicinity of the product holding platform, the at least one product size adjustment plate being exposed outside of the housing when inserted in the product containing chamber to limit a surface area of the stack of sheet products insertable in the product containing chamber and supported by the product holding platform; and wherein the housing includes guiding tracks extending in the product containing chamber, the product holding platform having protruding tabs having an end slidably engaged with the guiding tracks, and the at least one product size adjustment plate including at least one elongated slot being substantially aligned with a respective one of the guiding tracks with a respective one of the protruding tabs extending into the at least one elongated slot.

10. The sheet product dispenser as claimed in claim 9, wherein a surface area of the opening is greater than a surface area of the product holding platform.

11. The sheet product dispenser as claimed in claim 9, wherein the housing comprises guiding tracks extending in the product containing chamber, the product holding platform comprises protruding tabs having an end slidably engaged with the guiding tracks, and the at least one product size adjustment plate comprises at least one elongated slot being substantially aligned with a respective one of the guiding tracks with a respective one of the protruding tabs extending into the at least one elongated slot.

12. The sheet product dispenser as claimed in claim 9, wherein the housing comprises a bottom wall, a peripheral wall extending upwardly from the bottom wall and defining together the product containing chamber.

13. The sheet product dispenser as claimed in claim 12, wherein the housing further comprises an inner skirt extending inwardly from an upper edge of the peripheral wall with an inner edge of the inner skirt delimitating an opening providing access to the product containing chamber and the at least one product size adjustment plate comprises an upper surface filing substantially entirely a spacing defined between an edge delimitating the opening of the housing and an edge of the product holding platform when configured in a raised configuration, when the at least one product size adjustment plate is engaged with the housing.

14. The sheet product dispenser as claimed in claim 9, wherein the at least one product size adjustment plate comprises an upper surface which is substantially aligned with an edge delimitating an opening of the housing when engaged with the housing and including a resilient catch detachably engageable with the housing when the at least one product size adjustment plate is engaged therewith.

15. The sheet product dispenser as claimed in claim 9, wherein the at least one product size adjustment plate and the housing comprises complementary male-female members to detachably engage the at least one product size adjustment plate with the housing.

16. A sheet product dispenser comprising:

a housing defining a product containing chamber and comprising guiding tracks extending in the product containing chamber;

a product holding platform inserted in the product containing chamber and being slidably engaged with the guiding tracks, the product holding platform being configured to support a stack of sheet products thereon; and at least one product size adjustment plate insertable in the product containing chamber and detachably engageable with the housing in vicinity of the product holding platform to limit a surface area of the stack of sheet products insertable in the product containing chamber and supported by the product holding platform, wherein the at least one product size adjustment plate comprises at least one elongated slot substantially aligned with a respective one of the guiding tracks when engaged with the housing with the product holding platform having a portion extending into the at least one elongated slot to engage with a respective one of the guiding tracks.

17. The sheet product dispenser as claimed in claim 16, wherein the housing comprises a bottom wall, a peripheral wall extending upwardly from the bottom wall and defining together the product containing chamber, wherein the guiding tracks extend vertically along the peripheral wall.

18. The sheet product dispenser as claimed in claim 17, wherein the housing further comprises an inner skirt extending inwardly from an upper edge of the peripheral wall with an inner edge of the inner skirt delimitating an opening providing access to the product containing chamber and the at least one product size adjustment plate comprises an upper surface filing substantially entirely a spacing defined between an edge delimitating the opening of the housing and an edge of the product holding platform when configured in a raised configuration, when the at least one product size adjustment plate is engaged with the housing.

19. The sheet product dispenser as claimed in claim 16, wherein the at least one product size adjustment plate comprises an upper surface which is substantially aligned with an edge delimitating an opening of the housing when engaged with the housing and including a resilient catch detachably engageable with the housing when the at least one product size adjustment plate is engaged therewith.

* * * * *